US006415781B1

(12) United States Patent
Perrone

(10) Patent No.: US 6,415,781 B1
(45) Date of Patent: Jul. 9, 2002

(54) BULK LOADER FOR PAINTBALL GUN

(76) Inventor: Aldo Perrone, 7 Blue Jay Crescent, Brampton, Ontario (CA), LT 3Z8

( * ) Notice: Subject to any disclaimer, the term of this patent is extended or adjusted under 35 U.S.C. 154(b) by 0 days.

(21) Appl. No.: 09/434,428

(22) Filed: Nov. 4, 1999

Related U.S. Application Data

(60) Provisional application No. 60/123,718, filed on Mar. 10, 1999.

(51) Int. Cl.[7] ..... F41B 11/02
(52) U.S. Cl. ..... 124/51.1; 124/49
(58) Field of Search ..... 124/48, 49, 51.1; 221/200, 258, 277; 222/412

(56) References Cited

U.S. PATENT DOCUMENTS

| | | | | |
|---|---|---|---|---|
| 653,749 | A | | 7/1900 | Mackay |
| 1,235,765 | A | | 8/1917 | Brown |
| 1,403,719 | A | | 1/1922 | Szepe |
| 1,743,576 | A | | 1/1930 | Smith |
| 1,789,206 | A | | 1/1931 | Whatley |
| 1,927,424 | A | | 9/1933 | Trebenbach et al. |
| 3,263,664 | A | | 8/1966 | Bauer et al. |
| 3,348,531 | A | | 10/1967 | Yano |
| 3,476,100 | A | | 11/1969 | Carbonneau |
| 3,601,111 | A | | 8/1971 | Embry |
| 3,610,223 | A | | 10/1971 | Green |
| 3,695,246 | A | | 10/1972 | Filippi et al. |
| 3,749,280 | A | | 7/1973 | Gale |
| 3,844,267 | A | | 10/1974 | Mohr |
| 3,867,921 | A | | 2/1975 | Politzer |
| 4,207,857 | A | | 6/1980 | Balka, Jr. |
| 4,405,060 | A | | 9/1983 | Hsei |
| 5,166,457 | A | | 11/1992 | Lorenzetti |
| 5,282,454 | A | | 2/1994 | Bell et al. |
| 5,542,570 | A | * | 8/1996 | Nottingham et al. ... 221/227 X |
| 5,722,383 | A | * | 3/1998 | Tippmann et al. ..... 124/51.1 X |
| 5,794,606 | A | * | 8/1998 | Deak ..... 124/51.1 |
| 5,816,232 | A | * | 10/1998 | Bell ..... 124/51.1 |
| 5,947,100 | A | * | 9/1999 | Anderson ..... 124/49 X |

* cited by examiner

*Primary Examiner*—John A. Ricci

(57) ABSTRACT

A bulk loader apparatus for supplying paintballs to a paintball gun includes a housing for internally storing a quantity of paintballs, this housing having a bottom outlet through which stored paintballs can drop. A feed tube is connected to the housing at the bottom outlet and extends downwardly therefrom. This feed tube is connectible to the gun and capable of sequentially delivering the paintballs to the gun. An auger-like member is rotatably mounted at the bottom outlet and operable to clear a paintball feed jam or move one or more paintballs located at or near the outlet. The mechanism for controlling the operation of the moving member preferably includes a microswitch mounted in the feed tube for sensing the absence of a paintball within the feed tube. The control mechanism operates and moves the paintball moving member to clear the jam or move paintballs at the outlet when the position of the microswitch indicates the absence of a paintball.

12 Claims, 4 Drawing Sheets

BULK LOADER FOR PAINTBALL GUN

This application claims the benefit of the filing date of Provisional Application No. 60/123,718 filed on Mar. 10, 1999.

BACKGROUND OF THE INVENTION

This invention relates to bulk loaders for paintball guns.

Games played with paintballs have enjoyed great success in recent years and this has resulted in the development of a number of types and models of paintball guns that employ pressurized gas to shoot paintballs. These paintballs are spherical capsules which have an outer layer made from gelatin and this outer layer encloses a colored liquid which generally has an oil base. When a game player is hit with one of these paintballs by an adversary's gun, the paintball ruptures easily and leaves a visible color mark on the player.

It is well known to equip paintball guns with a bulk loader capable of holding a relatively large number of small paintballs. These bulk loaders can be mounted to one side of and above a semi-automatic paintball gun that is capable of shooting individual paintballs as fast as the trigger can be repeatedly pulled.

A variety of bulk loaders are known in the paintball gun industry. Typically, these loaders include a container or housing that is mounted to one side of the gun so that the gun can still be aimed properly by the user. The housing is also located above the gun so that paintballs can drop through a bottom outlet of the housing and will be fed by gravity to the loading mechanism of the gun. A feed tube is connected to the housing at the bottom outlet and this tube is connectible to the gun's own ball feeding section which can take the form of a hollow bent paintball tube that extends outwardly from the body of the gun.

One commonly encountered problem with known bulk loaders is that the paintballs can jam as they enter the feed tube during operation of the gun. A jam will, of course, prevent further paintballs from entering the feed tube causing the gun not to operate after several shots. It is a common practice to clear such jams by simply shaking the gun in order to dislodge the paintballs at the entrance to the feed tube. Shaking of the gun in this manner is obviously undesirable since it interferes with the operation of the gun, including the proper aiming of the gun.

U.S. Pat. No. 5,282,454 issued Feb. 1, 1994 to C.M. Support, Inc. describes a bulk loader for a paintball gun with an anti-jamming device. This known bulk loader employs an optical sensor to detect the absence of paintballs in the feed tube of the bulk loader and a rotatable agitator paddle member is mounted in the housing that stores the paintballs and can be operated to clear a paintball feed jam by shifting paintballs located around the bottom outlet of the housing. There is an electric motor operated by a small battery that is able to rotate the paddle member when the absence of a paintball in the feed tube is sensed.

It is an object of the present invention to provide an improved bulk loader apparatus for supplying paintballs to a paintball gun, this apparatus being equipped with a paintball moving member movably mounted at the bottom inlet and a mechanism for controlling the operation of this moving member.

SUMMARY OF THE INVENTION

According to one aspect of the invention, a bulk loader apparatus for supplying paintballs to a paintball gun comprises a housing for internally storing a quantity of paintballs, this housing having a bottom outlet through which stored paintballs can drop, and a feed tube mechanism connected to the housing at the bottom outlet and extending downwardly therefrom. The feed tube mechanism is connectible to the gun and capable of sequentially delivering the paintballs to the gun. There is also an auger-like member rotatably mounted at the bottom outlet and operable to move one or more paintballs located at or near the bottom outlet. A control mechanism operates auger-like member and includes a microswitch mounted in the feed tube mechanism for sensing the absence of a paintball within the feed tube mechanism at the location of the microswitch. The control mechanism operates and rotates the auger like member to cause one or more paintballs to drop into the feed tube when the position of the microswitch indicates an absence of a paintball.

According to a further aspect of the invention, a bulk loader apparatus for supplying paintballs sequentially to a paintball gun includes a housing for internally storing a quantity of paintballs, this housing having a bottom outlet through which stored paintballs can drop, and a feed tube connected to the housing at the bottom outlet and extending downwardly therefrom. This feed tube is connectible to the gun and capable of sequentially delivering the paintballs to the gun. There is also provided an auger-like member rotatably mounted adjacent the bottom outlet and in the housing. Rotation of this auger-like member during use of the apparatus acts to move one or more paintballs in the region of the bottom outlet. A mechanism for operating and rotating the auger-like member in order to move the one or more paintballs includes a motor operatively connected to the auger-like member in order to rotate same and an electrical switch mounted in the feed tube in order to sense the absence of a paintball within the feed tube at the location of the switch. The switch is capable of turning the motor on in order to move the one or more paintballs towards or at the bottom outlet when the operational state of the switch indicates an absence of a paintball.

According to another aspect of the invention, a bulk loader apparatus for supplying paintballs sequentially to a paintball gun includes a housing for internally storing a quantity of paintballs and a feed tube connected to the housing at its bottom outlet. A paintball dislodging ring is movably mounted at the bottom outlet of the housing and extends around this outlet. Movement of the dislodging ring acts to clear a paintball feed jam by moving one or more paintballs located at or near the bottom outlet. There is also a mechanism for operating and moving the dislodging ring in order to clear the paintball jam and this mechanism includes an electrical motor operatively connected to the dislodging ring in order to clear the paintball jam and an electrical switch mounted in the feed tube for sensing the absence of a paintball within the feed tube at the location of the switch. The electrical switch is able to turn the motor on in order to clear the paintball jam when the operational state of the switch indicates an absence of a paintball.

In this embodiment, the dislodging ring is preferably pivoted about a pivot axis in order to move the jammed paintballs located at the bottom outlet.

Further features and advantages of the present bulk loader apparatus will become apparent from the following detailed description taken in conjunction with the drawings.

DETAILED DESCRIPTION OF PREFERRED EMBODIMENT

Figure 1:
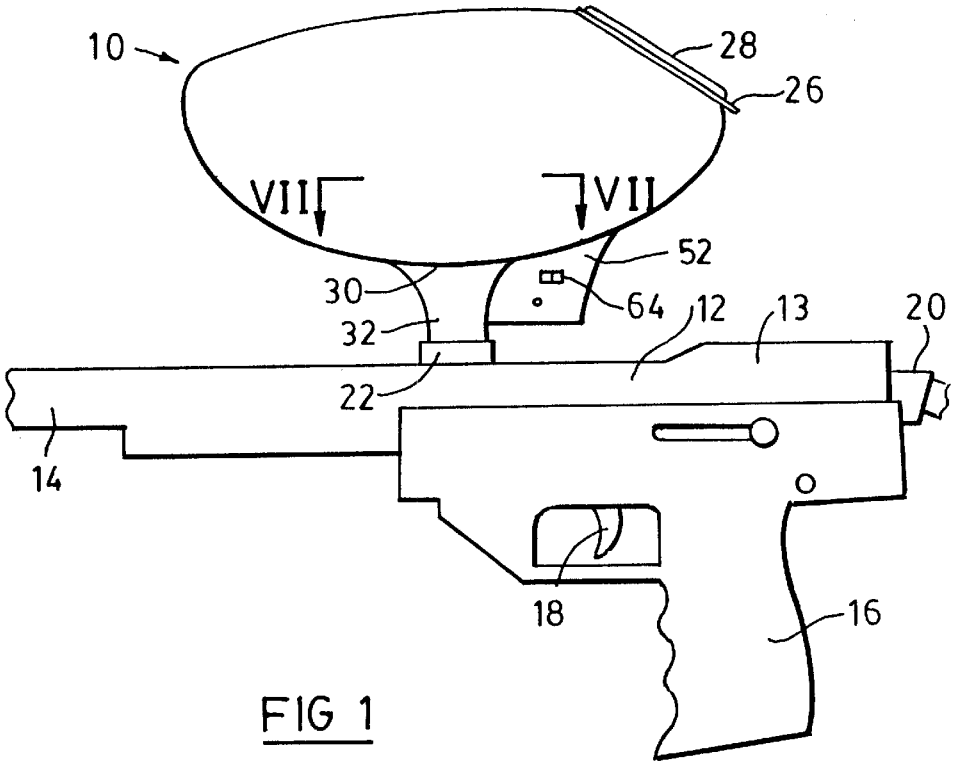
FIG. 1 is a side view of a bulk loader constructed in accordance with a first embodiment of the invention mounted on a semi-automatic paintball gun, portions of which have been omitted for ease of illustration.

FIG. 1 illustrates the improved bulk loader apparatus 10 of the invention mounted on a conventional paintball gun 12 of which only the central section is shown. The gun 12 can be of the semi-automatic firing type having a main body 13, a barrel 14, a handgrip 16 and a trigger 18. Other types of paintball guns can also employ the bulk loader of the invention. For example, the gun can be a pump action gun rather than semi-automatic. It will be understood that there can be connected to the rear end of the gun a $CO_2$ pressurized gas cannister that extends rearwardly. This cannister is connected to a cannister connector at 20.

In a well known manner, the gun 12 is fitted with a tubular elbow at 22 for the purpose of feeding standard paintballs to the firing chamber of the gun. The elbow 22 has an open top end to which the apparatus 10 can be detachably connected. It will be understood that paintballs stored within the housing 24 of the apparatus 10 are fed by gravity downwardly into the gun for firing by pressurized gas from the cannister. A paintball can be fired with each pull of the trigger 18.

Figure 9:
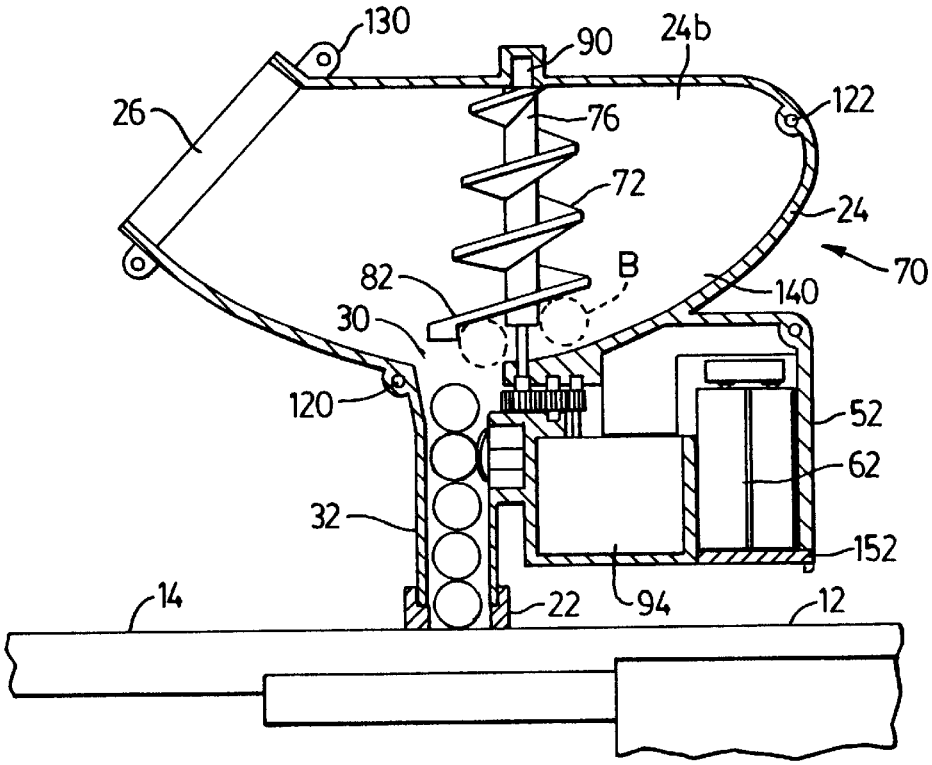
FIG. 9 is a cross-sectional elevation of another embodiment of the invention, this figure showing a portion of the paintball gun into which the paintballs are loaded and showing the bulk loader in cross-section taken along the line IX—IX of FIG. 11.
Figure 11:
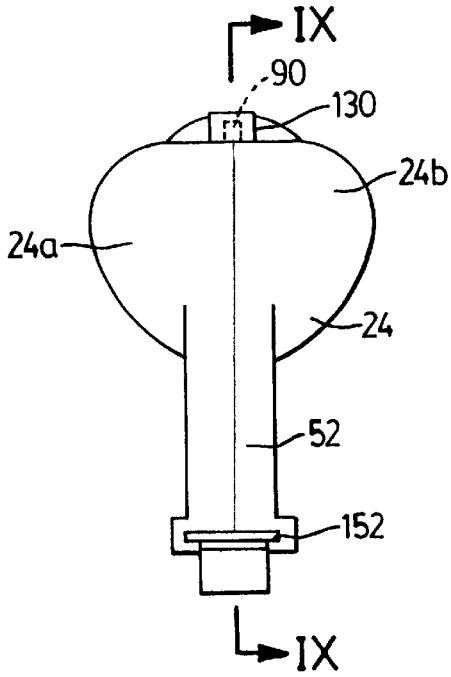
FIG. 11 is a rear view of the bulk loader apparatus of FIG. 9, this view omitting the top of the gun.

The preferred illustrated housing 24 can store a substantial quantity of standard paintballs, for example one hundred to two hundred, and it is provided with a relatively large opening at 26 through which the paintballs can be poured into the housing prior to use of the gun. After the paintballs have been placed in the housing, the opening 26 can be covered with a suitable plastic cap 28 which in a preferred embodiment is transparent so that the balls in the housing can readily be viewed by the user of the gun. The housing has a bottom outlet located at 30 through which stored paintballs can drop into a vertically extending feed tube 32. The walls of the housing can be rounded with the bottom section of the walls sloping towards the bottom outlet 30. The housing 24 can be made of molded plastic and should be sufficiently strong to resist breakage. As indicated in FIGS. 9 and 11, the preferred housing is made from two half sections 24*a* and 24*b* that are detachably connected such as by snap fasteners or screws located at 120, 122.

It will be understood that although the cap 28 as illustrated is completely detachable (for example, by flexing its peripheral rim or by means of threads) from the housing, it is also possible to provide a suitable hinge to pivotably connect the cap 28 to the housing. By connecting the cap in this manner, it cannot be easily lost or misplaced. A mounting bracket 130 for a hinge pin for the cap is illustrated on the housing shown in FIGS. 9 and 11.

In the illustrated preferred embodiment, the feed tube 32 is integrally formed on the bottom of the housing 24. The diameter of the bottom outlet 30 should be a little larger than the diameter of each paintball B. Paintballs are illustrated in FIG. 6 and in FIG. 9.

It will be understood that an open lower end section of the feed tube 32 extends into an upper end section of the elbow 22 and is detachably connected thereto. Preferably the internal diameter of the lower end of the feed tube is only slightly greater than the diameter of the paintballs and is smaller than the diameter of the bottom outlet 30 of the housing. Although a side feed arrangement for the gun is illustrated, the bulk loader of the invention can also be used in the known vertical feed arrangement for a paintball gun.

Figure 6:
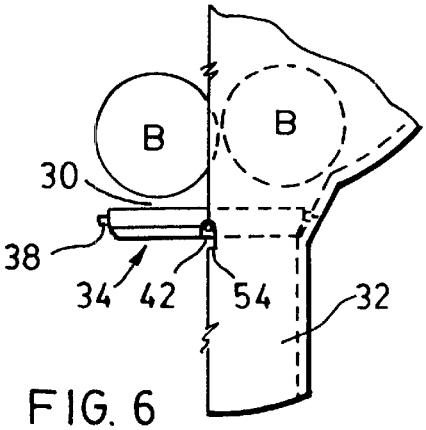
FIG. 6 is a detail view taken from the front and showing one half of the feed tube and the bottom outlet portion of the housing.
Figure 7:
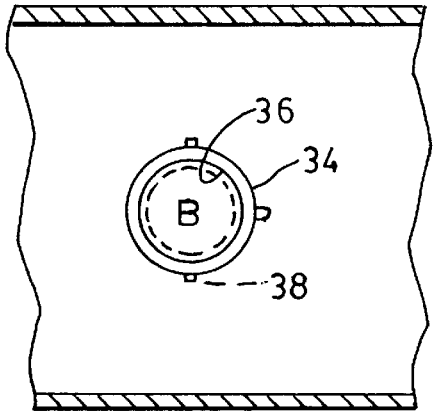
FIG. 7 is a cross-sectional detail view taken along the line VII—VII of FIG. 1.

It is possible for paintballs located around the bottom outlet as illustrated in FIG. 6 to create a jam within the housing so that paintballs no longer drop into the feed tube 32. If this occurs, the stack or row of paintballs in the feed tube can quickly be depleted, particularly when the gun is being fired rapidly. With a conventional bulk loader attached to a paintball gun, it then becomes necessary to shake the gun and loader to dislodge the jam and produce another row of paintballs within the feed tube.

Figure 4:
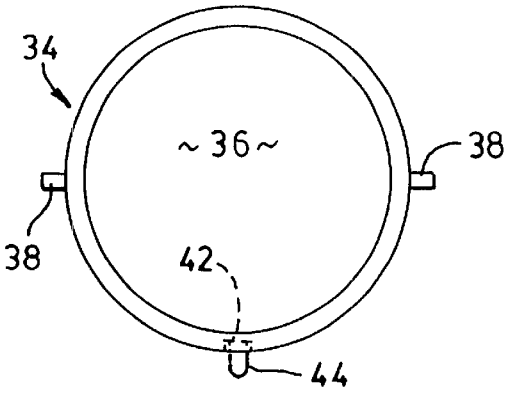
FIG. 4 is a top view of the movable ring member employed in the bulk loader.
Figure 5:
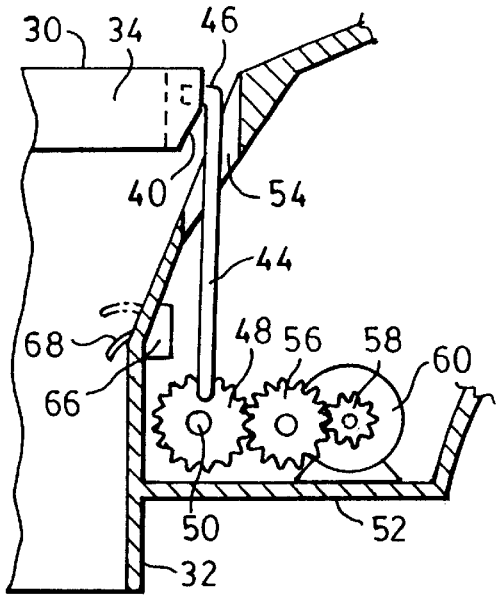
FIG. 5 is a cross-sectional elevation illustrating the gear train and link used to pivot the ring member of FIG. 4, this view being taken along the line V—V of FIG. 3.

In order to prevent such a jam from occurring and to move paintballs at the bottom outlet, the bulk loader of the present invention is provided with a paintball dislodging or moving member 34, which in the first embodiment is in the form of a ring. The ring 34 is movably mounted at the bottom outlet 30 and is operable to clear a paintball jam by moving one or more paintballs located at or near the bottom outlet. It will be understood that the member 34 defines a round aperture 36, the diameter of which is somewhat larger than the diameter of the paintballs B. The ring member can be made of a durable plastic or from metal. Mounted on opposite sides of the ring member are two short pivot pins 38. These pins 3 8 act to pivotably support the ring in small holes formed in the housing on opposite sides of the bottom outlet. As shown in FIG. 5, the outer circumferential surface of the ring can be tapered at 40 to assist in fitting the ring in the bottom outlet which can also be tapered in the region of the ring. Arranged at 90 degrees to the pins 38 is a small hole 42 into which the bent end of a link member 44 can fit. Only the upper end of this link member 44 can be seen in FIG. 4. As shown, the link is bent 90 degrees at its upper end to form a short connecting section 46. The link member is also bent 90 degrees at its bottom end where it connects to a first gear 48. The gear 48 is free to rotate about a central shaft 50. The ends of the shaft 50 can be rotatably mounted in the walls of a downward extension 52 of the housing. It will be noted that the bottom end of the link 44 is offset a suitable distance from the shaft 50 so that rotation of the gear 48 will cause the upper end of the link 44 to reciprocate a short distance upwardly and downwardly. One or two rotations of the gear 48 will usually be sufficient to dislodge the paintball jam. Note also that there is a small opening 54 in the side of the feed tube to permit passage of the link.

If desired and if required to enable the desired rotation of the gear 48, there can be a second ratio gear 56 whose teeth operatively engage the first gear 48 and a small drive gear. The drive gear 58 is mounted on the drive shaft of a small electric motor 60 contained within the downward extension 52. It will be understood that the second gear 56 is sized to rotate the first gear 48 at the desired speed which generally will be substantially slower than the speed of rotation of the drive gear 58. The size of the second gear 56 may be different than that illustrated in FIG. 5 and can in fact be smaller than the illustrated gear but larger than the drive gear.

Figure 2:
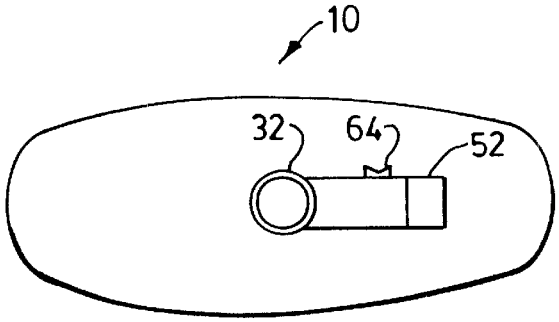
FIG. 2 is a bottom view of the bulk loader apparatus.
Figure 3:
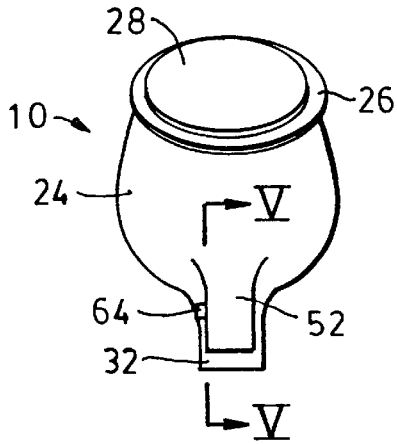
FIG. 3 is a front view of the bulk loading apparatus as seen from the rear end of the gun.
Figure 8:
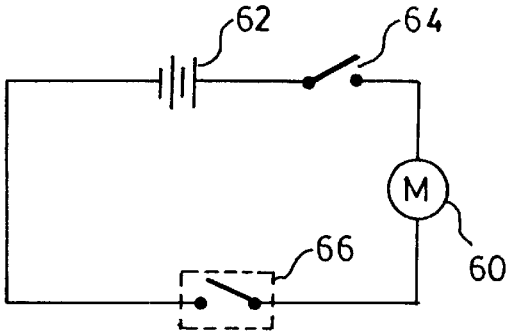
FIG. 8 is a schematic diagram of a DC electrical circuit utilized in this improved bulk loader apparatus.

Turning to the electrical circuit illustrated in FIG. 8, the small motor 60 can be powered by a small DC storage battery indicated at 62, which battery can be stored within the downward extension 52, if desired. The operation of the dislodging or moving member 34 can be activated or deactivated by the user by means of a manual on/off switch 64 that can be externally mounted on the apparatus as shown in FIGS. 1 and 2. The mechanism for controlling the operation of the dislodging member or ring 34 includes a mechanical switch, such as microswitch 66. The microswitch 66, which can be of standard construction, can be mounted on the outside of the feed tube 32 as shown in FIG. 5 and it can have a movable wire member 68 that extends through a hole formed in the side of the feed tube. When the gun is working properly and the feed tube is filled with a stack of paintballs B, the wire member 68 will be held in the down position illustrated in solid lines in FIG. 5. However, if a paintball jam should occur, the wire member 68 will move to an upper position indicated in dash lines in FIG. 5. In this position, the microswitch 66 is closed and, assuming the switch 64 has also been moved to the on position, this will close the circuit and cause the motor 60 to operate. As soon as the jam is cleared and paintballs again fall into the feed tube forming a stack, the wire member 68 will be pushed to its down position, opening the electrical circuit and turning off the motor.

Because the paintball moving member 34 is only pivoted in a reciprocating manner when this system senses the absence of a paintball at the location of the microswitch, the energy of the battery is efficiently saved and is only used when required. Thus, the operational life of the battery 62 can be reasonably long. Of course, when the gun 12 is not being used, the switch 64 is opened or turned off to prevent the possibility of unintended operation of the jam clearing system.

A second preferred version of the bulk loader apparatus for supplying paintballs to a paintball gun is illustrated in cross-section in FIG. 9. This bulk loader apparatus 70, like the first embodiment, has a housing 24 which can be made of a suitable, rigid plastics material and which can store internally a quantity of paintballs. The housing 24 has a bottom outlet 30 through which stored paintballs can drop. As in the version of FIG. 1, there is also a feed tube 32 connected to the housing at the bottom outlet and extending downwardly therefrom. The feed tube 32 is connected to the top or side of the gun 12 and delivers the paintballs sequentially to the loading mechanism of the gun.

Figure 10:
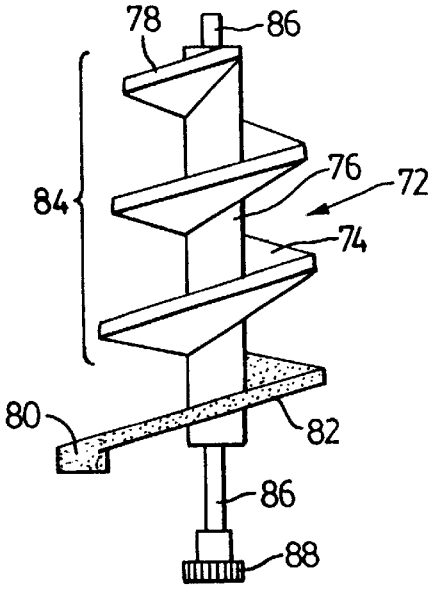
FIG. 10 is a side view of an auger-like member used in the bulk loader of FIG. 9.

In this version there is a helical auger-like member 72 which is rotatably mounted at its lower end adjacent the bottom outlet within the housing. The rotation of the auger-like member during use of the apparatus will tend to clear a paintball jam and to move one or more paintballs from the back section 140 of the housing towards the bottom outlet 30. The auger-like member or screw member has a spiral-shaped blade 74 which can extend around a central, elongate sleeve or shaft 76. In the illustrated preferred embodiment, the blade 74 has a variable outer diameter which increases from a top end at 78 to a bottom end 80. As illustrated in FIG. 9, the bottom end is close to or adjacent the bottom outlet 30 so that the member will be able to move paintballs that are causing a jam at the outlet. In order to avoid or lessen the possibility of any paintballs being crushed or damaged by rotation of the auger-like member, a lower portion 82 of the member can be made of a flexible rubber or rubber-like material. The upper portion 84 of the auger-like member can be made of a suitable rigid plastics material. The plastics portion of the blade can be integrally connected to the central sleeve or shaft 76. In the case of the rubberlike lower portion, an adjacent section of the sleeve can either be made of the same rubberlike material and can be integrally connected to the rubberlike blade or the rubberlike blade can be secured to the adjacent sleeve such as by means of a suitable strong adhesive. As illustrated in FIG. 10, the auger-like member can be mounted on a vertically extending, strong metal shaft or rod 86 and it should be secured against rotation on this rod or shaft by standard means such as the use of a spline or key connection or by adhesive. The rod 86 preferably extends to the top of the housing where it is rotatably mounted in a suitable circular hole or recess at 90. A bottom end section of the rod extends through the bottom of the housing as illustrated in FIGS. 9 and 12 and mounted at or near the bottom end is a suitable drive gear 88 which is part of the drive arrangement to rotate the rod and the auger-like member mounted thereon.

Figure 12:
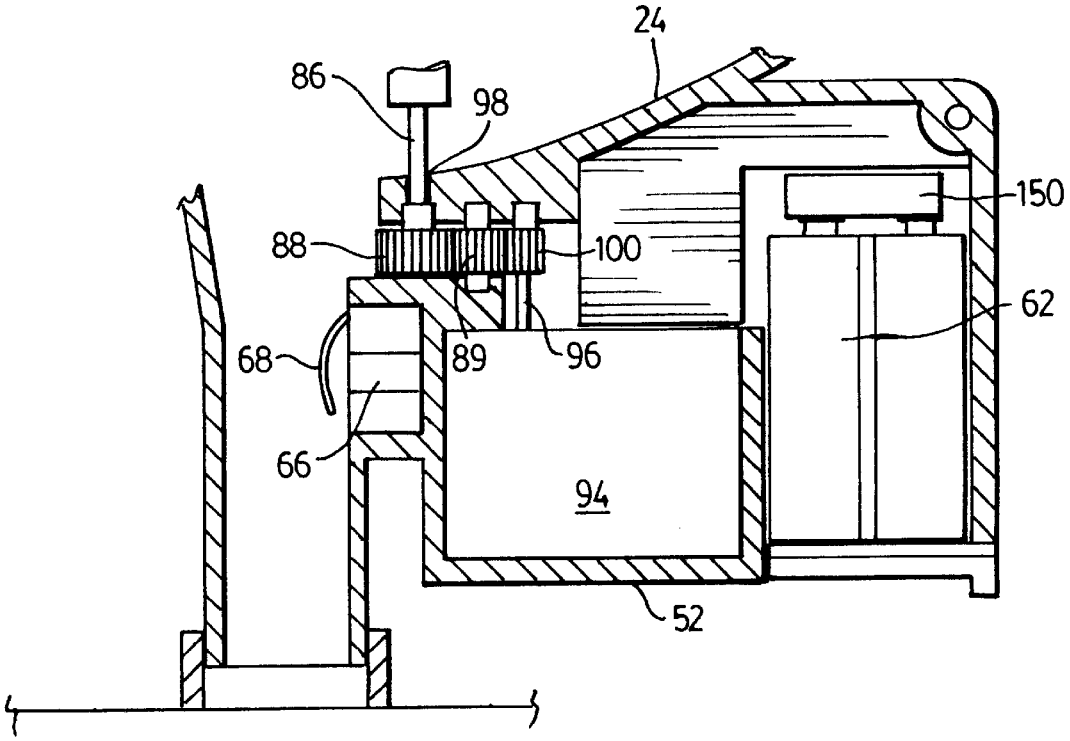
FIG. 12 is a cross-sectional view similar to FIG. 5 but showing the drive mechanism for the second embodiment of FIG. 9.

The controlling mechanism for the second embodiment is illustrated in part in FIG. 12 and in the above described FIG. 6 circuit diagram. As in the first embodiment, there is a small electric motor 94 which can be mounted within an enclosed downward extension 52 of the housing. In this preferred version there are two 9 volt DC storage batteries 62 capable of providing electric power to the motor 94. A battery contact block 150 of standard construction is detachably mounted on top of the batteries to connect same into the electrical circuit. Removably mounted below the batteries 62 is a battery cover 152. An output shaft 96 of the motor is operatively connected to the auger-like member 72 so as to be capable of rotating the latter upon operation of the motor. The rod or shaft 86 is rotatably supported in the bottom of the housing where it extends through a close-fitting, round hole 98. Mounted on the output shaft 96 is a drive gear 100 which interengages a middle gear 89 and rotates same while the gear 89 in turn engages the gear 88. It will be understood that the drive gear 100 can be made smaller than the gear 88 and the gear 89, if desired, in order to reduce the rate of rotation of the auger-like member which can be rotated at a rate of about one to two revolutions per second. As in the first embodiment, there is preferably a manual ON/OFF switch 64 in the electrical circuit for the motor 94. Only when the switch is turned ON and no paintball is sensed in the feed tube by the microswitch 66 will the auger-like member be rotated.

FIG. 9 illustrates how the flexible bottom portion of the helical auger-like member is arranged to sweep over the bottom outlet 30 and over the adjacent back area of the housing in order to dislodge a paintball jam and to move paintballs towards the bottom outlet. The bottom end of the blade should be located quite close to the bottom outlet while at the same time providing sufficient clearance to permit the auger-like member to rotate without striking the bottom or sides of the housing. It will be understood that the illustrated auger-like member rotates in a counterclockwise direction as seen in FIGS. 9 and 10 and from above. In this way, the paintballs in the region of the bottom outlet will tend to be swept or driven by the spiral blade towards the bottom outlet. The auger-like member can also rotate in the opposite direction if an opposite spiral arrangement is used in the auger-like member. The use of the preferred rubberlike material for the bottom end section of the auger will help prevent the paintballs from being crushed or damaged by the auger-like member.

It will be appreciated by those skilled in the art that the described embodiments for clearing paintball jams are relatively inexpensive to build while at the same time being quite reliable and easy to use. It will be further appreciated that various modifications and changes can be made to the bulk loader apparatus of this invention without departing from the spirit and scope of this invention.

I therefore claim:

1. A bulk loader apparatus for supplying paintballs to a paintball gun, said apparatus comprising:

a housing for internally storing a quantity of paintballs, said housing having a bottom outlet through which stored paintballs can drop;

feed tube means connected to said housing at said bottom outlet and extending downwardly therefrom, said feed tube means being connectible to said gun and capable of sequentially delivering the paintballs to the gun;

a screw member mounted at said bottom outlet and rotatable about a vertically extending axis, having a bottom end adjacent said bottom outlet, and operable when rotated about said axis to move one or more paintballs located at or near said bottom outlet; and means for controlling the operation of said screw member, said controlling means including a microswitch mounted in said feed tube means for sensing the absence of a paintball within said feed tube means at the location of said microswitch, wherein said controlling means operates and rotates said screw member to cause one or more paintballs to drop into said feed tube means when the position of said microswitch indicates an absence of a paintball.

2. A bulk loader apparatus according to claim 1 wherein said screw member has a spiral-shaped blade having an outer diameter which increases from a top of the screw member to said bottom end.

3. A bulk loader apparatus according to claim 2 wherein said screw member includes a vertically extending shaft around which said blade extends, said shaft extending from a bottom of said housing to a top thereof and being rotatably supported in said bottom and in said top of said housing.

4. A bulk loader apparatus according to claim 1 wherein said screw member has an upper portion made of rigid plastics material and a lower portion made of flexible rubber or rubberlike material.

5. A bulk loader apparatus according to claim 1 wherein said controlling means includes a small electric motor and at least one battery capable of providing electric power to said motor and an output shaft of said electric motor is operatively connected to said screw member so as to be capable of rotating the latter upon operation of said motor.

6. A bulk loader apparatus according to claim 5 wherein said controlling means further includes a manual ON/OFF switch and a set of rotatable gears that are interengaged and mounted between said output shaft of the motor and a central shaft of said screw member, whereby when said ON/OFF switch is in the ON position and said electric motor is operating, said screw member is rotated at a rate of about 1 to 2 revolutions per second.

7. A bulk loader apparatus for supplying paintballs sequentially to a paintball gun, said apparatus comprising:

a housing for internally storing a quantity of paintballs, said housing having a bottom outlet through which stored paintballs can drop;

a feed tube connected to said housing at said bottom outlet and extending downwardly therefrom, said feed tube being connectible to said gun and capable of sequentially delivering the paintballs to the gun;

a screw member rotatably mounted adjacent said bottom outlet and in said housing whereby rotation of said screw member during use of the apparatus acts to move one or more paintballs in the region of said bottom outlet; and a mechanism for operating and rotating said screw member in order to move said one or more paintballs, said mechanism including a motor operatively connected to said screw member in order to rotate same and an electrical switch mounted in said feed tube in order to sense the absence of a paintball within the feed tube at the location of said switch, said switch being capable of turning said motor on in order to move said one or more paintballs towards or at said bottom outlet when the operational state of said switch indicates an absence of a paintball.

8. A bulk loader apparatus according to claim 7 wherein said screw member is rotatable about a vertically extending axis and has a bottom end adjacent said bottom outlet.

9. A bulk loader apparatus according to claim 8 wherein said screw member has a spiral-shaped blade with an outer diameter which increases from a top end to said bottom end of the auger-like member.

10. A bulk loader apparatus according to claim 9 wherein a major upper portion of said blade is made of a rigid material and a lower portion of said blade is made of a flexible material.

11. A bulk loader apparatus according to claim 8 wherein said screw member has an upper portion made of rigid plastics material and a lower portion made of flexible rubber or rubberlike material.

12. A bulk loader apparatus according to claim 8 wherein said electrical switch is a microswitch having a movable wire member that extends into said feed tube and is capable of being engaged and moved by a paintball in said feed tube during use of the apparatus.

* * * * *